United States Patent [19]

Procak

[11] Patent Number: 4,795,087

[45] Date of Patent: Jan. 3, 1989

[54] FARE BOX

[76] Inventor: Kenneth A. Procak, 167 Linden Ave., Winnipeg, Manitoba R2K 0M9, Canada

[21] Appl. No.: 120,357

[22] Filed: Nov. 13, 1987

[51] Int. Cl.[4] ..... G07B 15/00

[52] U.S. Cl. ..... 232/7; 232/16

[58] Field of Search ..... 232/7, 9, 15, 16; 109/24.1

[56] References Cited

U.S. PATENT DOCUMENTS

| | | | |
|---|---|---|---|
| Re. 28,307 | 1/1975 | Dominick . | |
| 1,628,508 | 5/1927 | McElligott . | |
| 2,723,825 | 11/1955 | Miller . | |
| 2,884,188 | 4/1959 | Grant . | |
| 2,960,377 | 11/1960 | Simjian . | |
| 3,078,789 | 2/1963 | McGee . | |
| 3,108,741 | 10/1963 | Thomas . | |
| 3,667,485 | 6/1972 | Sesko . | |
| 3,670,955 | 6/1972 | Dominick . | |
| 3,966,116 | 6/1976 | Dominick . | |
| 4,130,238 | 12/1978 | Williams . | |
| 4,201,333 | 5/1980 | Oslin . | |
| 4,372,478 | 2/1983 | Gomez . | |
| 4,453,667 | 6/1984 | Zerfahs . | |
| 4,471,905 | 9/1984 | Sloma et al. | 232/15 X |
| 4,540,117 | 9/1985 | Landry | 232/7 |

*Primary Examiner*—Robert W. Gibson, Jr.

*Attorney, Agent, or Firm*—Stanley G. Ade; Adrian D. Battison; Murray E. Thrift

[57] ABSTRACT

A fare box includes a first coin receiving opening in an upper surface of the outer shroud and a second paper receiving opening also in the upper surface and defined by a horizontal surface over which the paper is fed. The feed system comprises a first elastomeric roller divided into three separate coaxial parts and cooperating with a first central narrow roller and a pair of belts on either side of the narrow roller for grasping the paper and directing it from the horizontal surface downwardly into an inspection zone. The inspection zone has a dump platter controlled by a time delay and a manually operable switch with the time delay being reset by the manually operable switch, by a switch responsive to the receipt of the fare and by a manually operable delay switch. A bolt which can be inserted into the outer casing has depressible pins which are guided by tracks on the casing so that the lid is moved to an open position as the bolt is inserted into the housing and is forced by the track into a closed locked position as the bolt is pulled out. The guide tracks are curved and the inlet guide track includes a ramp surface for depressing the pins into a compressed position before releasing them into the remainder of the guide track. Only when the bolt is removed can the outer shroud securing bolts be accessed for removal of the shroud for service on an inner carriage supporting the operating parts of the fare box.

20 Claims, 8 Drawing Sheets

FARE BOX

BACKGROUND OF THE INVENTION

This invention relates to a fare box of a type for receiving paid fares, for example, for public transport with the fares being supplied either in paper or in coin and token form for collection within a vault provided within a housing of the fare box.

Fare boxes of this general type which are currently available on the market place, are either of a very simple construction in which fares are dropped by the passenger through a vertical slot into a chamber, the lower wall of which is defined by a dump platter so that the fare drops onto the platter for viewing by the operator through a transparent wall. Devices of this type are generally satisfactory for fares in coins or token form but often have problems with fares in paper form since bills have very low mass and can tend to expand or open from the folded condition within the chamber and can in many cases hang up and block the chamber and interfere with the operation of the device. Further problems which arise with devices of this general simple type are the low levels of security which can enable the operator to remove or extract some of the takings. While this may on an individual basis be very small, on an ongoing bases it can constitute a significant loss to the overall income.

Other devices available on the market place tend to be extremely complex in that they have extensive electronic components used to control the device and used to measure and detect various coins, tokens or bills. Devices of this type have a significant problem in that they are very expensive to maintain and having high complication are prone to breakdown.

Other devices revealed in a patent search are shown in U.S. Pat. Nos. 4,453,667 (Zerfahs), 2,906,377 (Simjian), 3,667,485 (Sesko), 3,078,789 (McGee), 2,723,825 (Miller), 4,130,238 (Williams), 3,108,741 (Thomas), 4,372,478 (Gomez et al), 1,628,508 (McElligott), 3,966,116 (Dominick et al), 3,670,955 (Dominick et al), 4,201,333 (Oslin et al), 28,307 (G. G. Dominick et al), 2,884,188 (M. L. Grant et al).

Many of the above patents are included merely to show various examples of devices of this type. U.S. Pat. No. 1,628,508 (McElligott) discloses an arrangement for controlling movement of the lid of a vault contained within the housing of the device but this control is provided by a complex mechanical movement which is thus prone to breakdown and failure.

U.S. Pat. No. 3,108,741 (Thomas) discloses an electrical interlock system for the fare box device. However, this system is not designed for maximum security and it leaves open a significant possibility for improvement.

A number of the previous patents including for example, U.S. Pat. Nos. 4,130,238 (Williams) and 4,453,667 (Zerfahs) disclose feed arrangements for receiving paper material. However, these feed arrangements are not designed to accommodate fares fed in coin or token form and therefore problems can arise should a passenger or customer inadvertently feed one or more coins into the paper feed slot.

It is one object of the invention, therefroe, to provide an improved fare box which is better designed and adapted for its particular purpose.

It is a further object of this invention to provide a fare box which is able to accommodate fares provided in both paper and coin form without jamming of the paper within a display container and without the danger of a paper feed mechanism being jammed by the presence of one or more coins.

It is a further object of the present invention to provide a fare box including a dump platter onto which fares are deposited, with control of the dump platter being obtained by various switches on the device allow it to be controlled by the operator and which avoid the collection of excess fares on the dump platter and avoid the possibility of such fares being retained within the inspection zone and kept out of the vault when the vault is removed.

It is a further object of the present invention to provide a fare box in which security is improved by providing a vault which can be readily inserted into the housing of the fare box and is automatically locked by a simple mechanical technique which is resistant to tampering as it is removed from the housing to prevent any possibility of an unauthorized person obtaining access to the interior of the vault.

It is a yet further object of the present invention to provide a fare box of this type in which security is improved by allowing servicing of the fare box only after the vault is removed from the housing, thus preventing service personnel from obtaining access to any collected fares within the housing when acting to service of the fare box.

According to a first aspect of the invention there is provided a fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone and operable to release the fare therefrom, a vault arranged to receive and retain said fare from said dump means and comprising a container separate from the housing and including means co-operable with the housing such that the container can be inserted into and removed from the housing, and a fare forwarding drive assembly mounted in said housing rearwardly of said slot for grasping and feeding said fare to said inspection zone, said drive assembly comprising a first roller means, a second rollers means cooperable with the first roller means to form a nip therebetween, means for driving said roller means in a direction such that the fare is grasped in the nip and forwarded through the nip, and means providing a release action at said nip such that at least a portion of the nip can define a space between said first and second roller means so as to allow therethrough fares in coin and token form as well as fares in paper form.

According to the second aspect of the invention there is provided a fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone operable to release the fare therefrom, a vault arranged to receive and retain said fare from said dump means and comprising a container separate from the housing and including means co-operable with the housing such that the container can be inserted into and removed from the housing, and control means for controlling actuation of said dump means, said control means including a manually actuable switch arranged to actuate said dump means on operation of said switch by an operator, a timer circuit arranged to periodically and repeatedly operate said dump means after a predetermined period of time, a manually operable delay switch means arranged to reset said timer circuit and means responsive to feeding into said slot of a further fare to reset said timer circuit.

According to the third aspect of the invention there is provided a fare box comprising a housing, means defining a slot in the housing for receiving fares therethrough for collecting in the housing, an inspection zone in the housing having a transparent zone wall through which an operator can view a fare deposited in the housing, dump means for temporarily retaining fare in the inspection zone and operable to release the fare therefrom, a vault arranged to receive and retain said fare from said dump means and comprising a container separate from the housing and including means co-operable with the housing such that the container can be inserted into and removed from the housing, the vault including a lid, lock means for retaining the lid in a locked closed position when removed from the housing, the lid having a pair of pin members each projecting from the lid and being compressible into a retracted position and including spring means for biasing said pin members into a projecting position thereof and means for prevent compression of said pin members beyond said retracted position, said housing including a pair of track means each receiving a respective one of the pin members and including a first track portion for guiding respective pin member to force the lid into an open position as the vault is inserted into the housing and a second track portion for guiding the pin member to force the lid into the locked closed position as the vault is removed from the housing, the second track portion having a depth to receive the respective pin members in the projecting position thereof, the first track portion including a ramp surface arranged to gradually compress the pin member into the retracted position as the pin member moves along said first track portion, said ramp surface terminating abruptly at a junction between the first and second track portions so that further movement of the pin member beyond said ramp surface requires said pin member to remain on said second track portion.

According to the fourth aspect of the invention there is provided a fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone and operable to release the fare therefrom, a vault arranged to receive and retain said fare from said dump means and comprising a container separate from the housing and including means co-operable with the housing such that the container can be inserted into and removed from the housing, said housing comprising an outer casing surrounding and including the parts of the box and acting as a security shroud therefore an inner support structure on which the parts of the box are mounted, a door on the outer casing covering an opening within the outer casing in which the vault can be received, the door being movable to an open position to allow removal of the vault and to a locked closed position to fully close the outer casing, first removable fastener means accessible only from said opening for attaching said outer casing to the inner support structure so as the casing is held in place thereon, and second removable fastener means accessible only from said opening for attaching the housing to a support, said vault and said opening being arranged such that said first and second fastener means can only be accessed after removal of said vault.

According to a fifth aspect of the invention there is provided a fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone operable to release the fare therefrom, a vault arranged to receive and retain said fare from said dump means and comprising a container separate from the housing and including means co-operable with the housing such that the container can be inserted into and removed from the housing, said housing comprising an outer casing surrounding and enclosing the parts of the box and acting as a security shroud therefore, and an inner support structure on which the parts of the box are mounted, said transparent zone wall comprising a first transparent screen in said outer casing and a second transparent screen in said support structure aligned with said first transparent screen when said outer casing is in place as a shroud thereon, said first transparent screen being formed from a synthetic plastic material resistant to impact damage and said second transparent screen being formed from glass.

With the foregoing in view, and other advantages as will become apparent ot those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
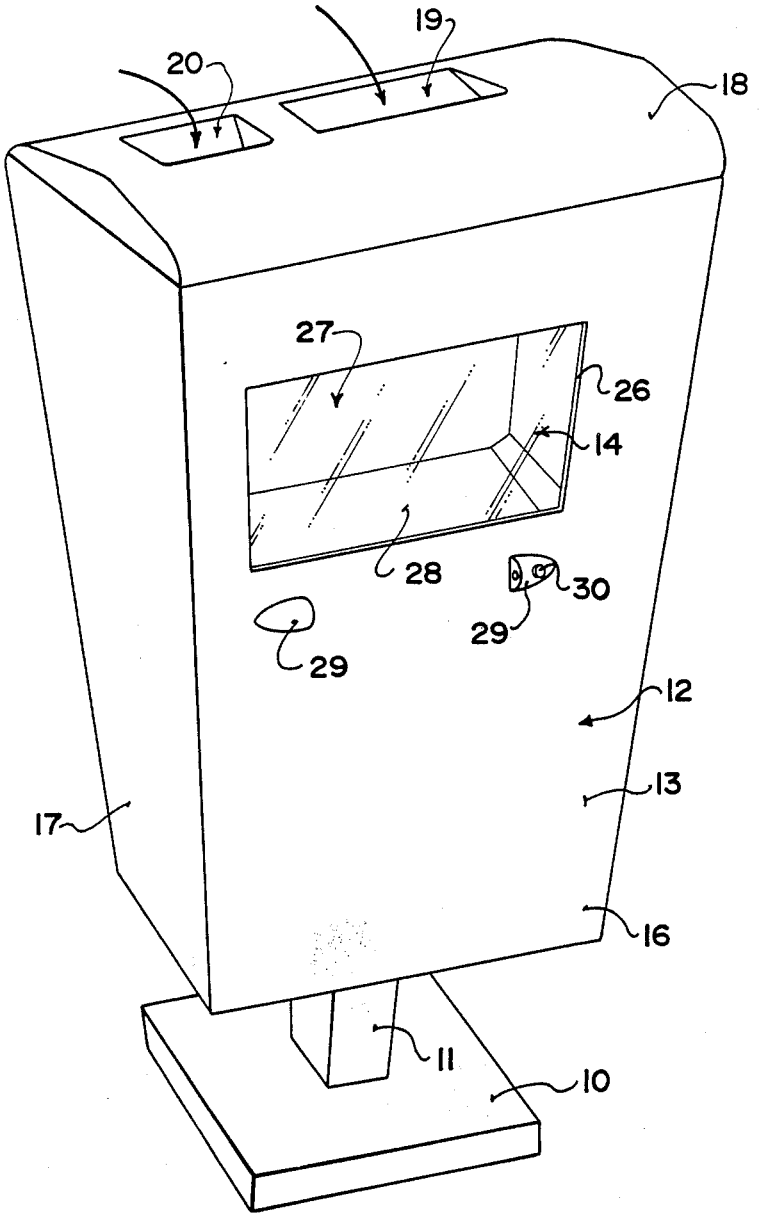
FIG. 1 is a perspective view of a fare box according to the invention showing a rear surface and one side thereof.
Figure 2:
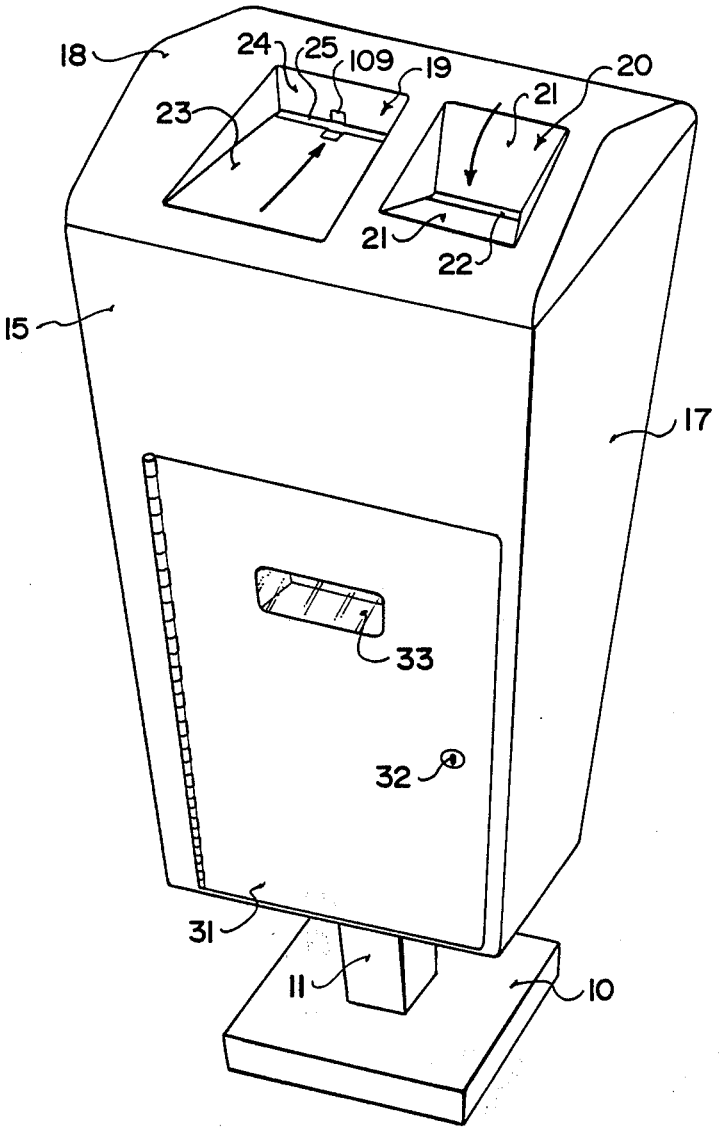
FIG. 2 is a perspective view of the fare box of FIG. 1 showing a front surface and an opposing side thereof.

The fare box shown generally in FIGS. 1 and 2 comprises a base plate 10 upon which is mounted a pedestal support 11 carrying a main housing 12 for the fare box. The main housing 12 includes an outer shroud 13 and an inner carriage 14 which is shown in most detail in FIG. 3.

The outer shroud 13 is generally of rectangular shape having a front surface 15, a rear surface 16 and sides 17. A curved upper surface 18 provides a top area for the housing into which generally the fares can be fed through a pair of feed openings 19 and 20 for deposit into the housing for inspection and collection therein.

The housing is manufactured from a rigid protective smooth material, for example, stainless steel, which provides a pleasing appearance and provides protection against impact damage from unauthorized and crude attempts at break in.

The feed opening 20 in the upper part of the shroud comprises simply a horizontally oriented slot with converging sides extending downwardly toward the slot so that fares generally in coin or token form can simply be dropped onto the converging side walls, particularly the v shaped sides 21 to pass into the slot indicated at 22 and fall into the interior of the shroud for collection.

The feed opening 19 is provided as effectively a vertical slot having on one side a horizontal surface 23 and on the other side a substantially vertical surface 24, so that passengers are encouraged to feed paper materials across the vertical surface 23 toward the horizontal slot 25 to be received therein and fed forwardly as explained hereinafter for collection within the fare box. An optic switch 10A is provided at the slot to detect the insertion of a fare, including an infra red transmitter on one side and a detector on the other side.

On the rear surface of the shroud adjacent the operator who will generally be seated at a driving position, for example, of a public transport vehicle, there is provided an inspection window 26 through which the operator can observe a fare deposited through the openings 19 and 20 into an inspection are generally indicated at 27 and onto a dump platter 28 on which the fares fall for inspection and from which the fares can be deposited into a vault to be described hereinafter.

Beneath the inspection area 27 is provided a switch mechanism 29 which can be actuated by the operator to cause movement of the dump platter 28 to deposit the inspected fare materials into the vault. The switch 29 is comprised of two parts projecting from the rear surface and forming an optic switch having an infra red transmitter in one of the parts and a suitable receiver in the other part with a beam normally extending therebetween, so that when then beam is interrupted by the physical presence of the operator, the switch is actuated and the dump platter moved. The use of optics, which provides a simple electronic control without mechanical movements, is thus inexpensive and of an extended operating life. A manual press switch 30 is provided on or adjacent one part of the switch 29 to act as a delay switch as explained hereinafter.

On the front face of the fare box as indicated at 15 is provided a door 31 which has suitable security lock 32 actuable to lock the door in a closed position fully closing the housing or shroud 13 to prevent unauthorized access. The door can be opened by an authorized person with the necessary key to expose the vault area for removal of the vault for collection of the fares and subsequent servicing of the fare box is necessary. Within the door there is provided an inspection opening 32 which allows the vault to be observed and particularly a code number on the vault to be presented at the inspection opening as a check on security.

Figure 3:
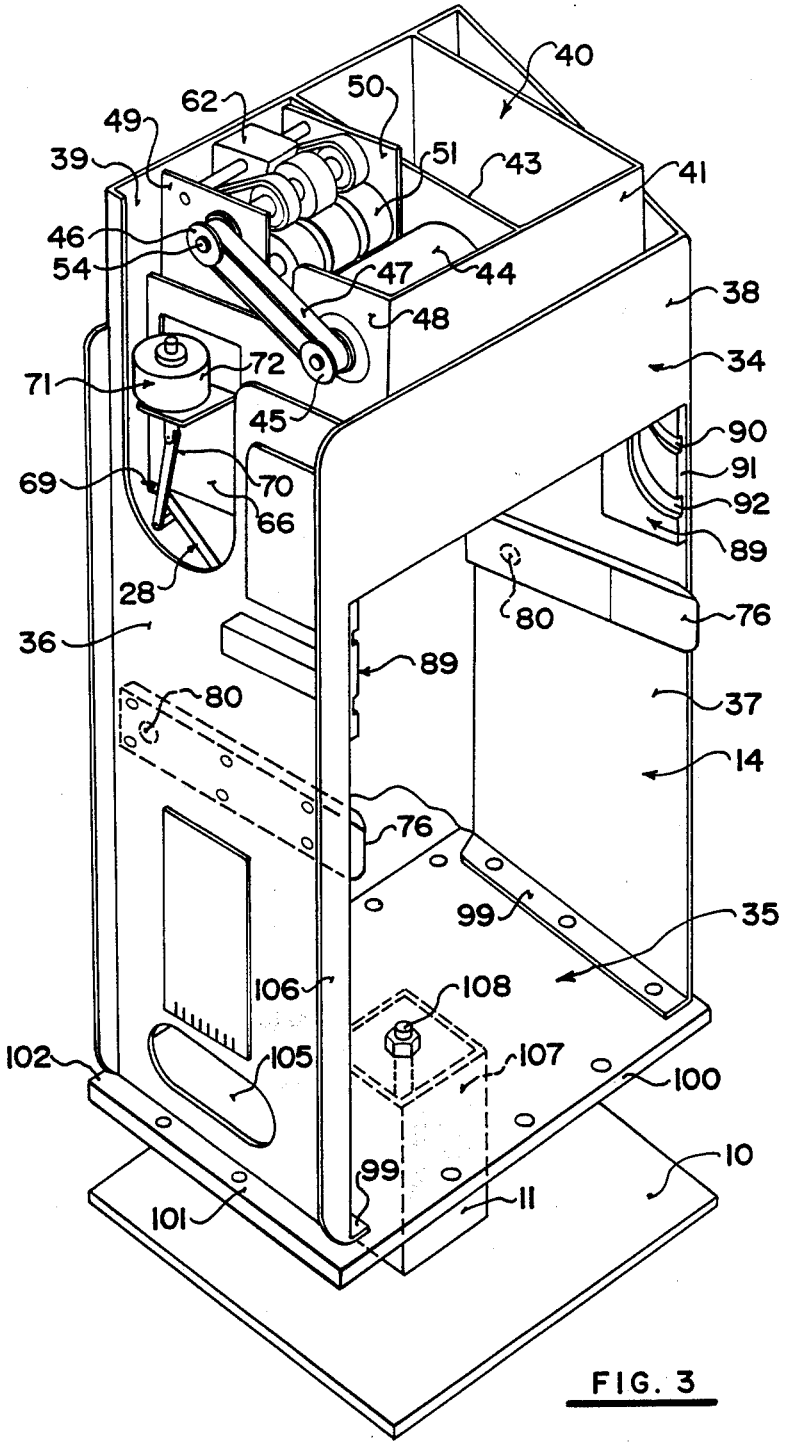
FIG. 3 is an isometric view of an internal carriage of the fare box of FIG. 1 with the outer shroud removed.
Figure 4:
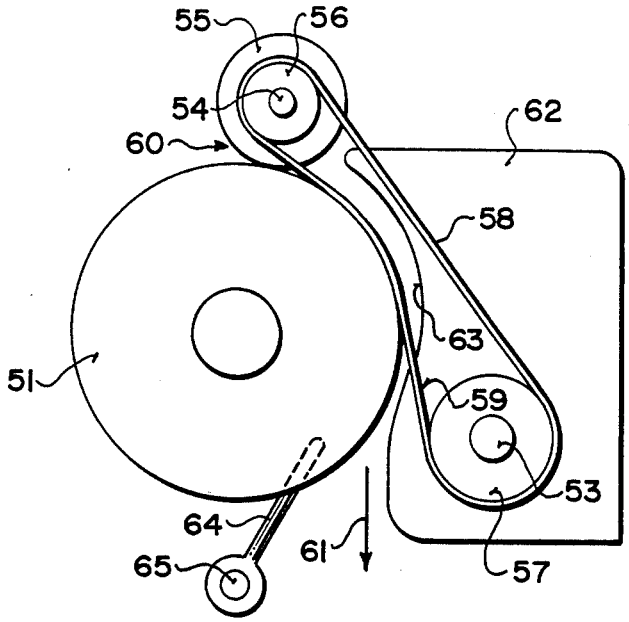
FIG. 4 is a side elevational view of the paper feed device of the fare box of FIG. 3.
Figure 5:
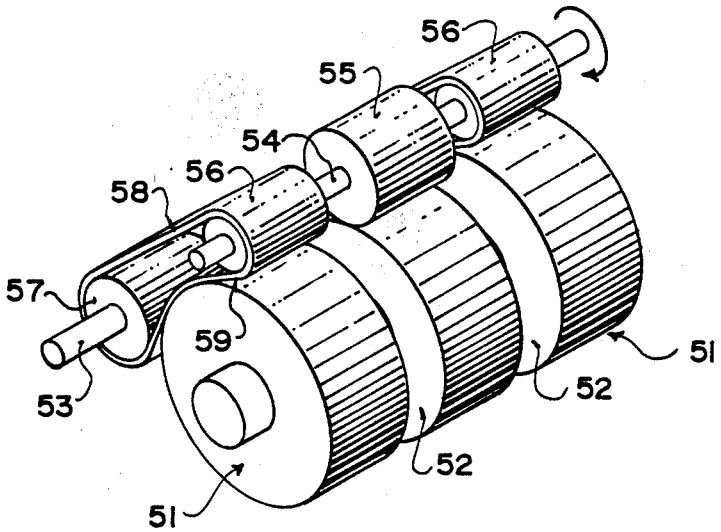
FIG. 5 is an isometric view of the paper feed device of FIG. 4.

Turning to FIGS. 3,4, and 5, the internal carriage 14 of the fare box is shown in detail together with particularly the feed arrangement for transporting fares from the feed opening 19.

The view of the inner carriage are shown in FIG. 3 constitutes the front surface indicated at 34 of the carriage which will in practice be covered by the front surface 15 of the shroud. The vault area of the lower part of the carriage is indicated at 35 and is open for receiving the vault through the door 31 when the door is open. The door is thus part of the outer shroud and when the shroud is removed, there is left a rectangular opening for receiving the rectangular vault.

The carriage is formed basically from a pair of upstanding side walls 36 and 37 with a transverse front face 38 and a transverse rear face 39, together with internal supporting walls. Basically the structure can be formed as a single casting to insure rigidity and structural strength.

At the upper part of the carriage is formed firstly a rectangular area 40 having one end defined by the rear face 39, the other end defined by an internal wall 41 and two sides 42 and 43 which are internal transverse sides. This rectangular section is arranged so that it lies directly beneath the feed opening 20 of the shroud so that the materials fed through the opening 20 are directed into the box section 40 from which they can fall directly into the viewing area 27. Arranged across the upper area of the section 40 is provided a pair of inclined guard surfaces (not shown) extending in opposed directions and both inclined downwardly so that coins dropped through the slot 22 fall onto one of the surfaces across to the other surface and down into the inspection area. The inclined surfaces both have serrated lower edges. The presence of the inclined guard surfaces prevents an unauthorized person from passing into the container an elongate object such as a wire in an attempt to remove materials from the inspection zone by pulling them upwardly through the slot 22. The serrated edges cause materials to be caught between the serrated edges and pulled off any such wire hook or the like.

The paper feed mechanism is shown generally in FIG. 3 and in more details in FIGS. 4 and 5. The paper feed mechanism comprises a drive motor 44 which can drive the feed mechanism through a pair of pulleys 45 and 46 connected by a timing belt 47. The motor is supported on internal walls 43 and 48 and the feed mechanism supported on internal walls 49 and 50 which carry suitable bearings (not shown).

The feed mechanism comprises a large idler roller 51 which is formed of a suitable elastomeric material to allow some compression when engaged by rigid material such as a coin. The elastomeric roller 51 includes a pair of slots 52 around the peripheral surface thereof, thus dividing the roller into three roller parts of substantially equal axial extent arranged coaxially and of equal diameter.

An opposing part of the feed mechanism is constituted by a pair of shafts 53 and 54, the upper one 54 of which is driven by pulley 46. On the shaft 54 is mounted a central larger roller 55 which is of diameter approximately half that of the roller 51 and which is arranged to roll against the middle part of the roller 51 to form a nip therebetween. On either side of the central larger roller 55 is provided a pair of smaller rollers 56 which are of slightly reduced diameter so that their surface is spaced away from the surface of the respective one of the outer parts of the roller 51. The spacing between the rollers 55 and 56 is arranged so that each of the rollers cooperates with the respective one of the parts of roller 51. On the shaft 53 is provided a pair of rollers 57 which are aligned with respective ones of the rollers 56 so as to receive wrapped around the aligned rollers a respective one of a pair of timing belts 58. The rollers 57 have flanges to guide the belts in alignment and to dislodge any fares clinging to the bests. The rollers 56 are flangeless. Each of the timing belts has an inner run 59 engaging the outer periphery of the end part of the roller 51 so as to form therewith a nip through which material can be fed. It will be noted that, as the diameter of the upper roller 56 is slightly less than that of the roller 55, a V-shaped area indicated at 60 is defined in which the inner run 59 of the belt gradually converges toward the outer peripheral surface of the roller 51.

In operation paper fare materials spread across the horizontal surface 23 engage the nip between the cooperating parts of the feed assembly generally from the right hand side as shown in FIGS. 3 and 5 and from the left hand side as shown in FIG. 4 which is of course a view from the opposing end. The paper fare materials are thus grasped by the nip and forwarded through the nip to be expelled from the feeder arrangement in a generally vertical direction at the point indicated by the arrow 61. In order to confine materials fed solely by the central roller 55 such as a rolled up bill or small coin, a guide structure 62 is provided which has an inner curved surface 63 spaced from the outer peripheral surface of the roller 51 and cooperating with the middle part thereof. The width of the structure 62 is such that it sits between the belts 58. When paper material is grasped by the device, this is simply forwarded either by the roller 55 alone or by the roller 55 in combination with one or another or both of the belts 58. The guiding action of the belts and the surface 63 insure that the material drops at the point of the arrow 61. In addition a pair of projecting pins 64 can be provided which project from a support bar 65 into the slots 52 to insure stripping of any materials adhering to the roller 51.

Should any coins or tokens or other thicker materials be fed into the slot 25, these can be accommodated firstly by deformation of the elastomeric roller 51 with its separation into three separate parts sllowing ready deformation. Secondly a slight side ways movement or twisting movement of the materials away from the roller 55 toward the more flexible areas defined by the belts 58. The natural elasticity of the belts allows a thicker material to enter the v-shaped area 60 and then to be carried around the periphery of the roller 51 by the belt itself and deposited at the arrow 61. Using timing belts allows them to be under zero tension and hence they can readily flex. The V-shaped area 60 prevents any jamming of the thicker materials if they are fed into the device, even in the case where an inexperienced passenger attempts to place a number of coins into the paper feed slot in place of the proper coin feed opening 20. The belts ensure that flat bills are carried through the feed system for proper deposit into the inspection cone without getting hung up in the system.

Turning now to FIGS. 3, 6, 7 and 8, the inspection compartment 27 is shown in more detail. The compartment 27 is defined by side walls 66 and 67 which may be constituted by parts of the walls 40 and 49 previously described or may be armed by separate internal walls as required. A rear wall of the inspection compartment is indicated at 68 and the base of the inspection compartment is defined by the dump platter 28. The dump platter comprises a horizontal plate mounted upon a hinge 69 which allows it to move from the horizontal position shown in the drawings to a lowered position which may be of the order of 45 degrees to the horizontal. Actuation of the movement of the dump platter is obtained by a strap 70 moved vertically to the upper and lower positions by a linear actuator 71 including a stepping motor 72 driving a lead screw (not shown) carrying an actuating rod 73 connected to the strap 70. Thus the linear actuator 71 tends to have a stable position at its upper closed location shown in the drawings and can automatically move downwardly by rotation in one direction of the stepping motor 71 to a lowered position at which it has a dwell followed by operation of the stepping motor 71 in the opposed direction to lift the strap 70 upwardly to close the platter 28.

The walls forming the inspection zone are configured so that all material dropping from the feed opening 19 and 20 fall in to the inspection zone and particularly onto the platter 28 for inspection by the operator. Inspection can be obtained through a transparent window defined by an inner glass screen 74 carried on the inner carriage 14 and through an outer polycarbonate screen indicated at 75 and carried on the outer shroud 13. The glass screen actually forms a front wall for the inspection compartment so that any coins dropping into the inspection compartment will engage the glass screen or the other side walls of the compartment with the glass being resistant to scratching or marking which could otherwise after a time reduce transparency and interfere with proper inspection. The polycarbonate layer 75 of the outer shroud covers the glass screen and forms part of the impact resistant shroud to inhibit crude attempts to break through the transparent window. The use of the glass screen also ensures that a more sophiscated thief cutting through the polycarbonate layer has to physically break the glass screen which will of course leave signs of damage.

Figure 6:
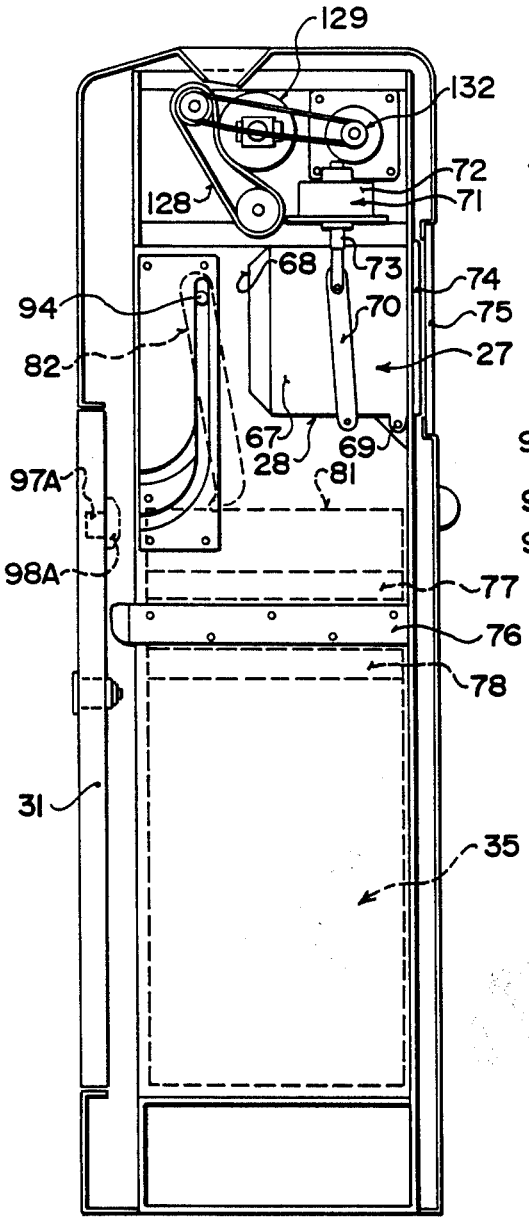
FIG. 6 is a cross-sectional view taken along a plane extending from front to rear of a modified fare box similar to that of FIGS. 1 through 3, but including a modified fare feed system, and being floor mounted with bolts coming upwardly through the floor or mounting surface.
Figure 7:
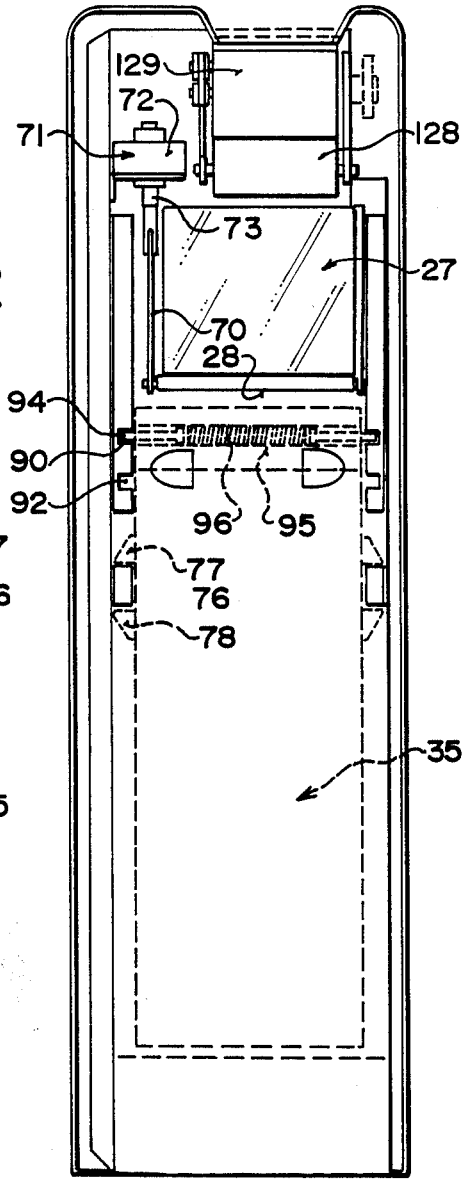
FIG. 7 is a rear elevational view of the fare box of FIG. 6 partly broken away to show internal parts.
Figure 8:
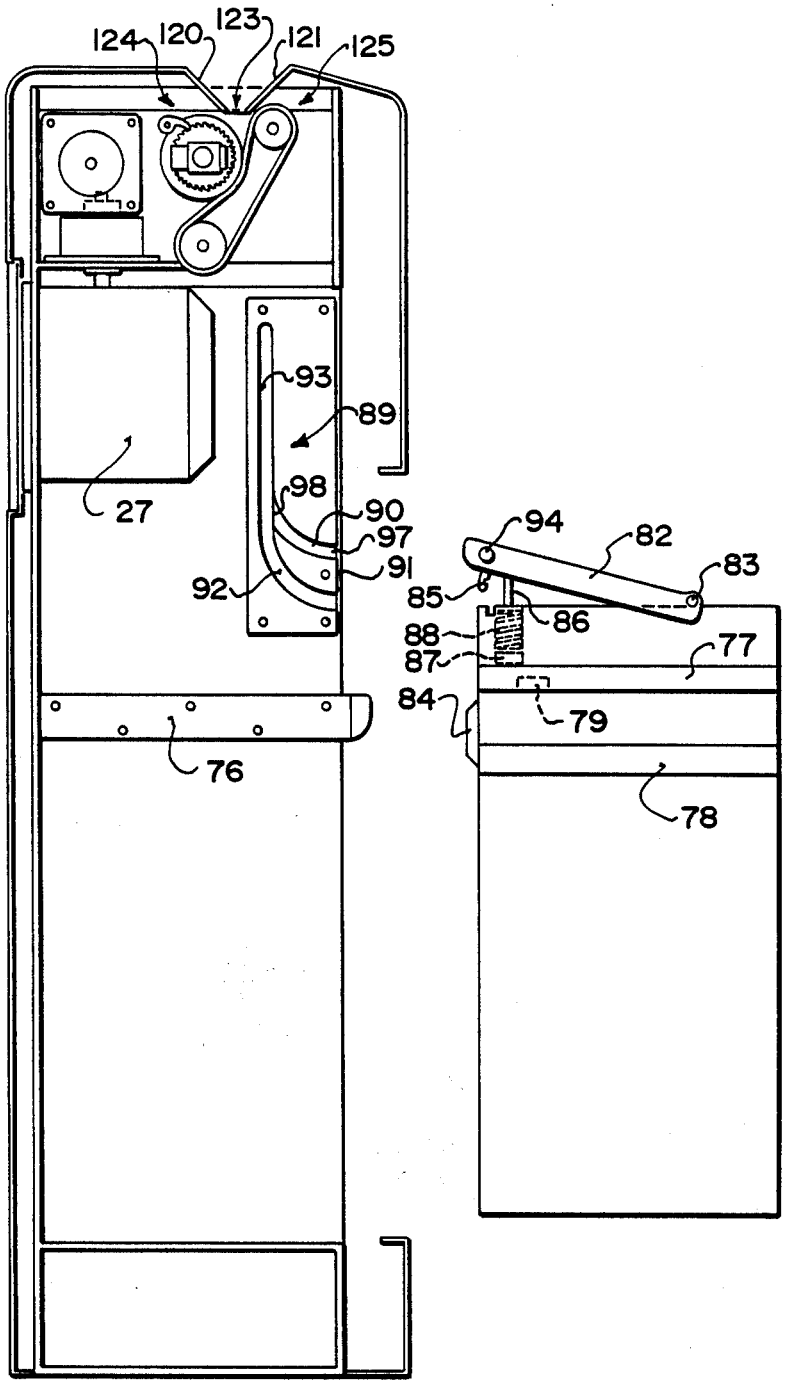
FIG. 8 is a cross-section view of of the fare box of FIG. 6 but taken from the opposing direction.

In FIGS. 6 and 7 as shown in dotted line, the vault is inserted into the vault section 35 in the inner carriage 14 through the door 31. In FIG. 8, the vault is shown in a position ready for insertion into the vault receiving section with the door 31 in an opened condition and therefore not visible.

The vault basically comprises a rectangular box of a size to be just received inside the vault receiving section 35. The vault receiving section 35 includes a pair of rails 76, each arranged on a respective one of the upstanding sides 36 and 37 on the inner face thereof. On each side of the rectangular vault is provided a pair of cooperating ribs 77 and 78 for engaging over and beneath respectively the rail 76 so that the vault is properly guided in its movement into the vault receiving opening within the inner carriage and is prevented from any movement other than a horizontal inserting and removing movement. The rib 77 carries an internally concealed magnet 79 which cooperates with a Hall effect switch 80 also concealed and provided in each of the rails 76 so as to provide an indication by way of the switch 80 that the vault is properly in place within the inner carriage.

An upper surface of the vault is open over its full width and part of its depth as indicated at 81 in FIG. 6 with the opening 81 being closable by a lid 82 pivoted on hinge 83 at the edge of the opening 81. The lid extends rearwardly from the hinge 83 toward the rear of the vault and includes an upper planar cover surface and depending sides which engage around the upstanding walls of the vault. A key operated lock 84 is provided on the rear surface of the vault and operable to engage a suitable striker pin 85 on the lid to hold the lid in a closed position when it is pressed downwardly into engagement with the upper surface of the vault. As shown in FIG. 8 the lid can be retained in a slightly raised position by a pivotal flag 86 which can be manual ly lifted to a position sitting over the side of the vault so as to engage an underside of the lid and to hold the lid in the raised position. The flag in the raised position projects outwardly over one side of the vault and is supported in its position by a supporting bracket 87 and engaged by a spring 88 within the bracket 87 to pull the flag downwardly to frictionally hold in its raised position. When the flag however is twisted about its vertical axis, it returns to a position wholly within the vault and is pulled downwardly into the bracket 87 so as to release the lid and allow it to be moved into the closed and locked position.

On an inner surface of each side 36 and 37 of the inner carriage is provided a guide track mechanism indicated at 89. The guide track mechanism 89 includes a first track portion 90 which opens on a front edge 91 of the guide track mechanism at a substantially horizontal inclination. A second track portion 92 similarly opens onto the edge 91 but is spaced downwardly from the first track portion 90. From the initial horizontal orientation, each of the track portions curve upwardly to intersect with a vertical portion 93 which extends upwardly therefrom to a position alongside the inspection zone 27.

At the edge of the lid 82 arranged at the rear of the vault is provided a pair of pins 94 each of which projects outwardly in a horizontal direction from a respective side of the lid. As shown in FIG. 7 the pins are carried in a transverse tube 95 which is mounted on the lid and extends across the full width of the lid and cooperates with suitable openings in the depending side walls of the lid. Each of the pins is biased by spring 96 into a projecting position at a predetermined extent from the outer surface of the side of the lid. Each of the pins can be depressed against the spring bias into a retracted position extending partly outwardly from the outer surface of the side wall of the lid which in practice can be one third of their projecting length and are prevented from further depression.

In operation, with the flag 86 in its raised position, the vault is moved rearwardly to a position in which the rails 76, 77 and 78 cooperate to receive the vault in its horizontal movement. At this position the pins 94 enter the first portion 90 of the track guide mechanism so that the vertical height of the pins is governed by the position of the track as the vault moves further inwardly into the vault receiving area. Thus each of the pins is constrained to move along the first curved track portion 90 and onto the straight vertical track portion 93 so that the lid is raised as the vault is inserted. When the vault is fully inserted the lid takes up the position shown in FIG. 6 which is a fully opened position with the lid lying alongside the inspection zone and arranged to copperate with the dump platter 28 to ensure that all materials falling from the dump platter pass through the opening 81 into the vault.

Each of the track portions 90 is constituted by a ramp surface which has a depth at the open end indicated at 97 sufficient to receive the pin 94 in its fully projecting position. The depth of the track portion 90 from that position 97 gradually decreases by virtue of the ramp surface so that at an end of the track portion 90 indicated at 98 intersecting with the second track portion 92 and the vertical track portion 93, the depth is sufficient only to just receive the pins 94 in their retracted positions, that is the pins must be effectively fully compressed to allow their passage to the end of the track portion 90 with only a very small clearance therebetween. At the end of the ramp surface, the depth increases abruptly at the junction between the track portions so the pins expand outwardly to take up their projecting position for further movement along the track portion 93.

It will be apparent therefore that when the vault is removed from the vault receiving area by being pulled forwardly along the guide 76, the pins 94 run back down the vertical track portion 93 and are prevented from entering the track portion 90 by virtue of the abrupt depth change at the point 98. The pin thus must follow the track portion 92 which is arranged with its open mouth spaced from the rail 76 by distance to ensure that the lid is locked as the vault is pulled from the vault receiving area.

The fact that the ramp surfaces compress the pins to their fully retracted position with little cleanance, and that both the track portions 90 and 92 are curved prevents an attempted break-in by implements pressed into one of the tracks to hold the pins in their retracted positions as they move down the track portion 93.

When the vault is fully inserted into the vault receiving area, as shown in FIG. 6, the door 31 can be closed and locked preventing further access to the vault. The door also includes a concealed magnet schematically indicated at 97A which cooperates with a HALL effect switch 98A mounted on the inner carriage at a suitable location.

As best shown in FIG. 3, the lower edges of the sidewalls 36 and 37 are turned inwardly to define mounting flanges 99 which are bolted to a flat mounting plate 100 which is of a size substantially to receive the carriage 14 that extends slightly outwardly therefrom as indicated at 101 to one side and as indicated at 102 to the rear. The shroud as indicated at FIGS. 6 and 7 includes at a lower edge thereof a flange 103 extending along a rear surface thereof for bolting to the rear projecting lip 102 of the plate and a similar flange 104 for bolting to the sidewardly projecting lip 101. The inner carriage 14 includes an opening 105 and a side flange 106 adjacent the side lip 101 of the plate to allow access to the bolts in the lip 101 through the opening 105. Access to the bolts in the lip 102 can be obtained through the vault receiving area 35. However with the vault in place, no access can be obtained to the lips 101 and 102 so that the covering shroud or outer casing must remain in place while the vault is in situ. For servicing of the device, the outer shroud must be removed since it fully encases the device and prevents any access to the parts carried by the inner carriage. In order to remove the bolts attaching the shroud to the base plate 100, the vault must therefore firstly be removed with its removal causing locking of the vault as previously described. Service personnel who must in some cases obtain access to the device must therefore remove the vault and thus remove any access to money contained within the device before they can remove the shroud to carry out a servicing action.

On the underside of the plate 100 is provided a collar 107 which receives therein the square post 11 of the pedestal base. In order to clamp the plate 100 down onto the post 11, a central bolt 108 is provided which extends through a hole centrally of the plate 100 downwardly through the collar 107 and through the post 11 for engagement with the floor beneath the base plate 10. Again therefore the whole unit is prevented from being removed from the base plate and removed from the floor of the vehicle in which it is placed by the central bolt 108 which is only accessible as best shown in FIG. 6 subsequent to removal and locking of the vault.

Figure 9:
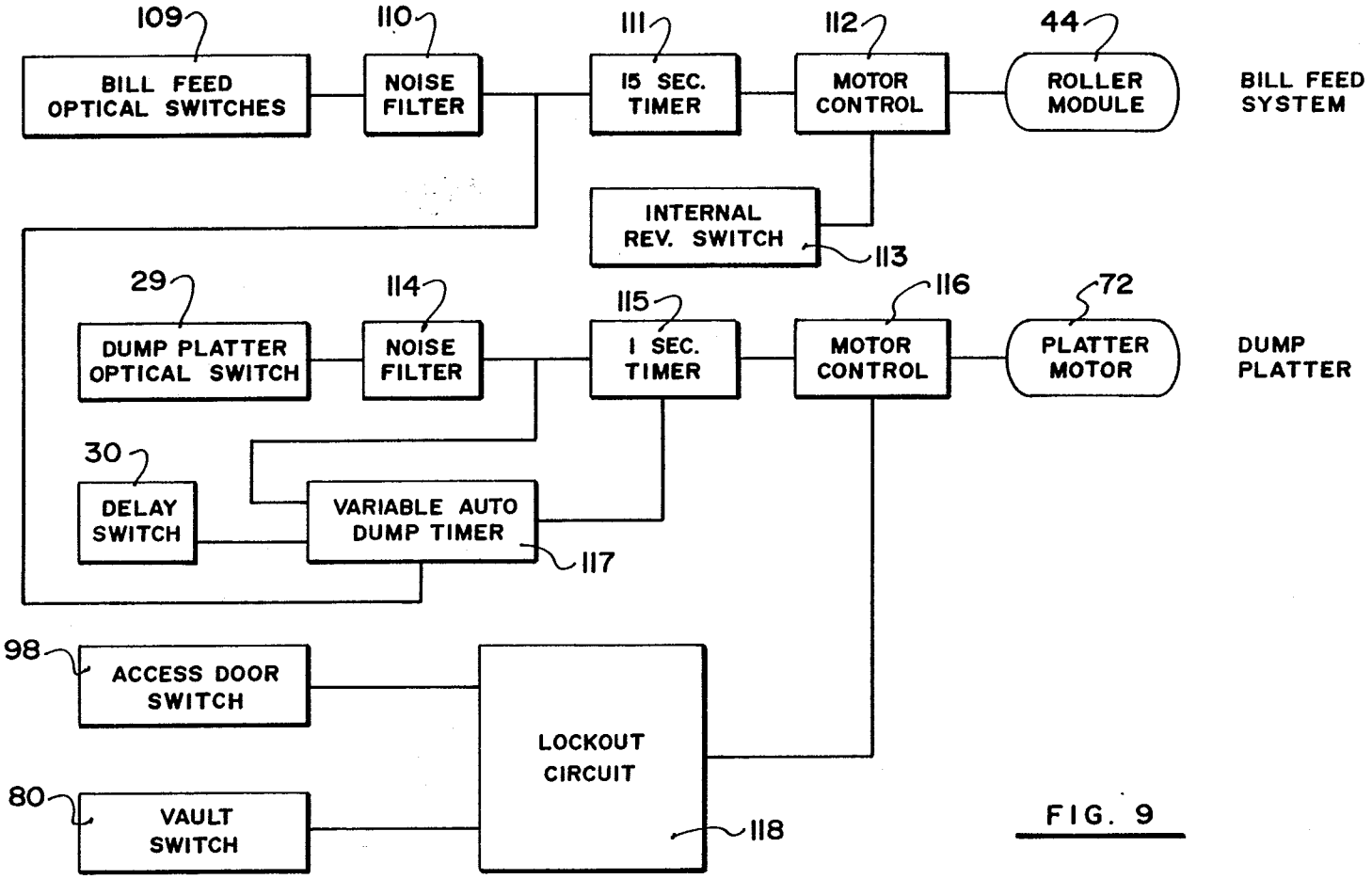
FIG. 9 is a schematic diagram of the electronic control system for the fare box of the previous drawings.
Figure 10:
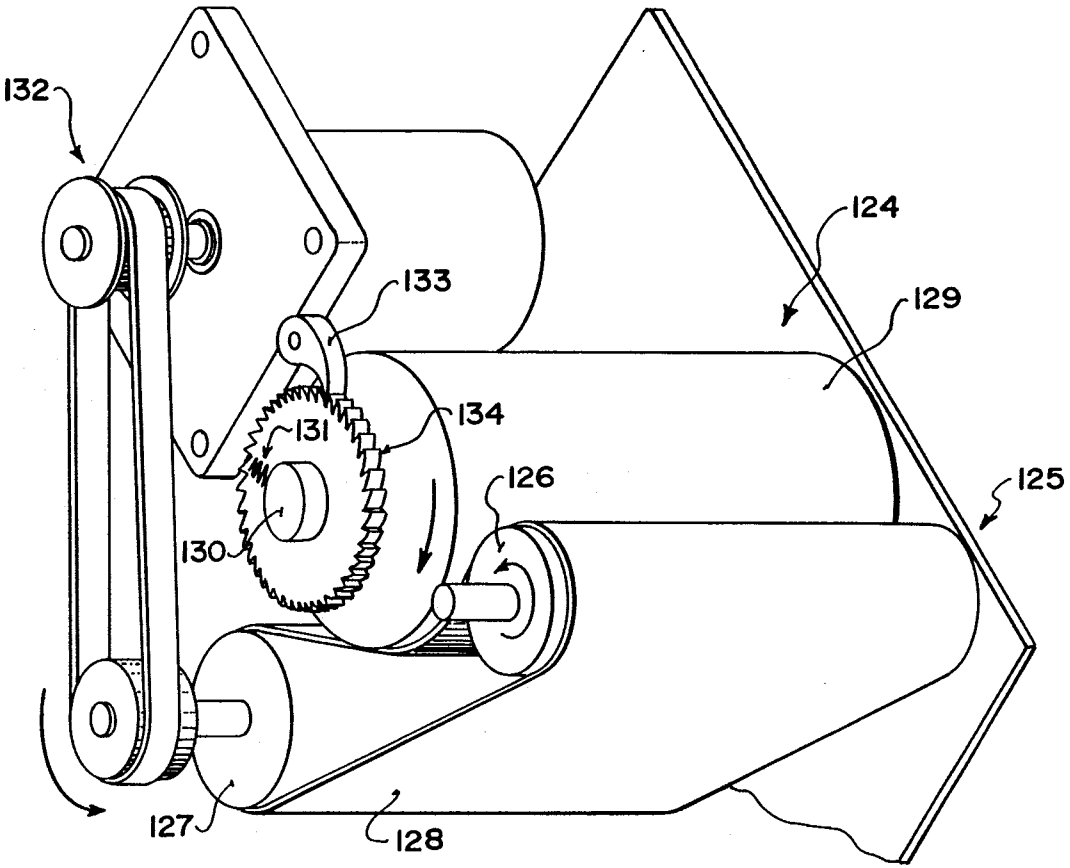
FIG. 10 is an isometric view of the feeding system shown in FIGS. 6, 7 and 8.

Turning now to FIG. 9 , the control system for the device is schematically shown. Specifically the control system includes input from the manually actuable dump platter optical switch 29 previously described and mounted on the rear face of the outer cover adjacent the operator. In addition the system includes input from the delay switch 30 similarly mounted at the dump platter switch 29. The system also includes input from the access door switch 98 constituted by the Hall effect switch mounted suitably adjacent the door. The system also includes input from the Hall effect switch 80 indicating the presence of the vault. Yet further the system includes input from the further optical switch arrangement indicated at 109 which is provided in the feed opening 19 to sense the presence of a fare fed by a passenger across the horizontal feed surface 23.

The system operates to control both the motor 44 driving the feed system and also the linear actuator 72 operating the dump platter.

Specifically the detection by the switch 109 of the presence of a fare is passed through a suitable filter 110 to a timer 111 which causes actuation of the roller drive motor 44 through a motor control 112. This system is arranged so that each actuation of the switch 109 causes the drive to the motor 44 to occur for the timed period which in the example shown in 15 seconds. In addition a failure of the switch 109 is arranged to cause continuous operation of the motor 44 so that if switch 109 fails or its wiring, the feed system runs continuously to allow further feeding of fares until service on the unit can be obtained when the vehicle returns. For convenience of servicing, a reversing switch 113 is provided operable only by a service person from within the housing for cleaning or for dislodging a jam.

The dump switch 29 is similarly passed through a filter 114 to a timer 115 which operates the linear actuator or platter motor 72 through a control 116. The timer 115 merely operates to provide a dwell in the operation of the linear actuator to hold the platter at an open position for a short period of time to ensure that all materials are properly deposited.

In addition to operation of the timer 115 by the switch 29, the timer 115 can also be actuated by an automatic dump timing circuit 117 which is arranged to provide a signal repeatedly at a predetermined delay period which in one example may be 90 seconds. Thus the dump platter is operated by a signal from the timer circuit 117 every 90 seconds in the absence of any further signals from any of the inputs. This ensures that even if the operator omits to operate the manual switch 29, the device itself periodically dumps any fares collecting in the inspection chamber to prevent their accumulation. The timer circuit 117 can be reset by three inputs. The first of those inputs is the operation of the dump switch 29 so that the predetermined period (90 seconds) is reset after the dump is operated manually by the operator.

Secondly the predetermined period is reset by operation of the bill feed switch 109 to avoid the situation where the circuit 117 times out just the fare is being deposited onto the platter for inspection. Thus the feeding of a fare into the box is detected and the timer is reset to allow the fare to sit in the inspection chamber for a sufficient period of time for inspection by the operator, following which he can manually operate the dump platter swtich or he can wait till the circuit 117 times out and automatically operates the dump platter motor.

Thirdly the delay switch 30 can be manually operated to reset the timer circuit 117. The delay switch is provided so that when any fare dispute arises, the fare in question can be maintained on the dump platter for inpsection while the matter is under dispute. The delay switch will of course act to reset the timer so that the fare is maintained for the predetermined period (90 seconds) until the dump platter is again automatically operated. Of course the delay switch can be operated again to provide a further delay period should this be necessary.

Both the access door switch 98 and the vault switch 80 develop signals which are submitted to a lockout logic circuit 118. The circuit is arranged so that actuation of the access door switch by an opening of the door causes the logic circuit 118 to actuate the motor 72 to cause a single dumping and closing of the dump platter. This ensures that any accumulated fares within the inspection zone are dumped into the vault bypassing the operation of the timer and the delay switch. It also ensures that the platter is and remains closed when the vault is removed to prevent any interference between them. With the access door opened and the switch 98 actuated the motor control holds the linear actuator under power to hold the platter closed to inhibit any manual force applied to open the platter when the vault is removed.

The logic circuit 118 also controls the system so that after the single operation of the dump platter described above, further operation of the dump platter is prevented until both the door switch 98 and vault switch 80 are actuated to confirm that the vault is in place and the door closed.

An alternative construction of the fare feed mechanism is shown in FIGS. 6, 7, 8 and 10 and designed for use with a single receiving slot which can accommodate fares both in paper and in coin or token form. In this case the single slot has inclined sidewalls 120 and 121 leading to a horizontal slot 123 through which the fares can be merely dropped by the passenger, whether these fares be in paper form, in coin or token form or a combination of these forms. In this case the feed mechanism comprises a first roller assembly generally indicated at 124 and a second roller assembly generally indicated at 125. The roller assembly 125 comprises a first roller 126 and a second roller 127 arranged in parallel spaced relation with a timing belt 128 wrapped therearound.

The roller assembly 124 comprises a larger diameter single roller 129 mounted on a shaft 130 which is mounted for movement in a horizontal direction towards and away from the belt 128. The shaft 139 is biased in a direction towards the belt 128 by a spring 131 so as to form a nip between the peripheral surface of the roller 129 and the belt 128 both of which are approximately of the same width and of a width greater than or substantially equal to the width of the slot 123.

The roller 126 is driven by a motor 132 in a direction so that the belt and the roller act to feed materials through the nip from the slot 123 toward the inspection zone 27. It will be noted that the roller 125 is mounted at a position slightly spaced from the periphery of the roller 129 so that the belt wrapped around the roller 126 forms a V-shaped area as it converges toward the peripheral surface of the roller 129 into which the material can be received. The bulk or thickness of the material can be taken up initially by elasticity of the roller 129, by flexing of the belt which is under no tension and furthermore by the movement of the shaft 130 away from the belt should that material be excessively thick or bulky for example a number of coins all dumped simultaneously.

In order to prevent attempts at break in by inserting a foreign body through the slot 123 and around the nip into the inspection zone 27, the roller 129 is prevented from reverse rotation by a pawl 133 which cooperates with a ratchet 134 corotatable with the roller 129. The position of the pawl is arranged at an upper edge of the roller 129 so that a force upwardly on the roller 129 caused by an attempt to pull back for example a wire inserted into the inspection zone 27 causes a couple on the roller to be formed by the forces applied by the pawl 133 and by the spring 131 tending to move the roller toward its nip with the belt 128 and thus to compress the foreign body and prevent its rearward movement with any bills or other materials of value.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone and operable to release the fare therefrom, a vault arranged to receive and retain said fare from said dump means and comprising a container separate from the housing and including means co-operable with the housing such that the container can be inserted into and removed from the housing, and a fare forwarding drive assembly mounted in said housing rearwardly of said slot for grasping and feeding said fare to said inspection zone, said drive assembly comprising a first roller means, a second roller means co-operable with the first roller means to form a nip therebetween, means for driving said roller means in a direction such that the fare is grasped in the nip and forwarded through the nip, and means providing a release action at said nip such that at least a portion of the nip can define a space between said first and second roller means so as to allow therethrough fares in coin and token form as well as fares in paper form.

2. The invention according to claim 1 wherein said first roller means comprises a first cylindrical roller and in said second roller means comprises a second cylindrical roller and wherein said means providing a release action comprises at least one further roller arranged coaxially with said second roller and rotatable therewith and having a diameter less than a diameter of the second roller so that further roller has a peripheral surface spaced from the first roller and a belt wrapped around said further roller and extending therefrom to an idler roller so that the belt wraps around said first roller for cooperation therewith in forwarding said fares.

3. The invention according to claim 2 including a pair of said further rollers, each arranged on a respective side of said second roller and each including a respective belt cooperating with the first roller.

4. The invention according to claim 2 including a fixed guide extending arcuately around said first roller and spaced therefrom in a path generally following said belt, said guide surface being aligned with said second roller so as to guide material forwarded from the nip between the first and second rollers around the first roller.

5. The invention according to claim 2 wherein the first roller is formed of an elastomeric material.

6. The invention according to claim 2 wherein said housing includes a first slot adapted for receiving coins deposited vertically therein and a second slot at which said drive assembly is mounted, said second slot having a substantially horizontally feed surface across which fares in paper form are forwarded into said slot.

7. The invention according to claim 1 wherein said means providing a release action comprises means mounting said first roller means for resilient movement in a direction so that the axis of the first roller means moves away from an axis of the second roller means to increase spacing therebetween, and including spring biasing means for biasing first roller means towards said second roller means.

8. The invention according to claim 7 wherein said second roller means comprises a pair of separate rollers having a belt wrapped there around, the belt having a width substantially equal to a width of said first roller means and wherein first roller means comprises a cylindrical roller body arranged so that the body engages and co-operates with the belt between said pair of rollers so that each of the pair of rollers is spaced from the cylindrical body.

9. The invention according to claim 7 wherein said first roller means includes means for preventing reverse rotation thereof arranged at a part of the roller adjacent the slot so that a force applied to the first roller means in a direction to rotate said first roller means in a reverse direction tends to generate a couple with said spring biasing means acting to close said nip.

10. The invention according to claim 8 wherein said slot includes guide surfaces directing material into said slot, said guide surfaces extending upwardly and outwardly from opposed sides of said slot, said first roller means being arranged on one side of said slot and said second roller means being arranged on the opposed side of the said slot with an upper one of said pair of rollers spaced away from said first roller means thus defining a V-shape which converges from the upper roller to a position of the belt first contacting said first roller means into which said fares are fed from said slot.

11. A fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone operable to release the fare therefrom, a vault arranged to receive and retain said fare from said dump means and comprising a container separate from the housing and including means co-operable with the housing such that the container can be inserted into and removed from the housing, and control means for controlling actuation of said dump means, said control means including a manually actuable switch arranged to actuate said dump means on operation of said switch by an operator, a timer circuit arranged to periodically and repeatedly operate said dump means after a predetermined period of time, a manually operable delay switch means arranged to reset said timer circuit and means responsive to feeding into said slot of a further fare to reset said timer circuit.

12. The invention according to claim 11 wherein said housing includes door means moveable to an open position to expose said vault and wherein there is provided door switch means responsive to said opening movement of said door and arranged to actuate said dump means immediately upon detecting said opening movement of said door means.

13. The invention according to claim 11 including vault switch means responsive to the absence of the vault, said vault switch means being arranged to prevent actuation of said dump means.

14. The invention according to claim 11 wherein said dump means includes a linear actuator arranged to drive said dump means in an opening and closing movement thereof, said linear actuator including a rotatable motor and a lead screw arrangement driven by said motor whereby the dump means is resistant to actuation thereof by manual force applied thereto.

15. A fare box comprising a housing, means defining a slot in the housing for receiving fares therethrough for collecting in the housing, an inspection zone in the housing having a transparent zone wall through which an operator can view a fare deposited in the housing, dump means for temporarily retaining fare in the inspection zone and operable to release the fare therefrom, a vault arranged to receive and retain said fare from said dump means and comprising a container separate from the housing and including means co-operable with the housing such that the container can be inserted into and removed from the housing, the vault including a lid, lock means for retaining the lid in a locked closed position when removed from the housing, the lid having a pair of pin members each projecting from the lid and being compressible into a retracted position and including spring means for biasing said pin members into a projecting position thereof and means for prevent compression of said pin members beyond said retracted position, said housing including a pair of track means each receiving a respective one of the pin members and including a first track portion for guiding respective pin member to force the lid into an open position as the vault is inserted into the housing and a second track portion for guiding the pin member to force the lid into the locked closed position as the vault is removed from the housing, the second track portion having a depth to receive the respective pin members in the projecting position thereof, the first track portion including a ramp surface arranged to gradually compress the pin member into the retracted position as the pin member moves along said first track portion, said ramp surface terminating abruptly at a junction between the first and second track portions so that further movement of the pin member beyond said ramp surface requires said pin member to remain on said second track portion.

16. The invention according to claim 15 wherein each of said track means is arranged at a respective side of the housing and including track openings presented forwardly of the housing, said first track portion being substantially horizontal such that horizontal movement of the vault into the housing cause the respective member to follow the first track portion, a further track portion extending from said first track portion in a substantial vertical direction so as to raise said lid into said open position thereof, and said second track portion being connected to said further track portion at a junction thereof with said first track portion and extending in a substantially horizontal direction at a position lower than said first track portion so as to lower said lid into said locked position thereof, both said first and second track portion being non-linear.

17. The invention according to claim 16 wherein said vault includes a releasable projecting member arranged to hold said lid in a slightly raised position such that movement of said vault in a horizontal direction into said housing causes said pin member to engage said track opening of said first track portion, said releasable projecting member being arranged to be released on insertion of said vault into said housing to allow said lid to move to said locked closed position on removal from said housing.

18. A fare box comprising a housing, means defining a slot in the housing for receiving fares therethrough for collecting in the housing, an inspection zone in the housing having a transparent zone wall through which an operator can view a fare depositied in the housing, dump means for temporarily retaining the fare in the inspection zone and operable to release the fare therefrom, a vault arranged to receive and retain said fare from said dump means and comprising a container separate from the housing and including means co-operable with the housing such that the container can be inserted into and removed from the housing, said housing comprising an ouer casing surrounding and including the parts of the box and acting as a security shroud therefore an inner support structure on which the parts of the box are mounted, a door on the outer casing covering an opening within the outer casing in which the vault can be received, the door being movable to an open position to allow removal of the vault and to a locked closed position to fully close the outer casing, first removable fastener means accessible only from said opening for attaching said outer casing to the inner support structure so as the casing is held in place thereon, and second removable fastener means accessible only from said opening for attaching the housing to a support, said vault and said opening being arranged such that said first and second fastener means can only be accessed after removal of said vault.

19. The invention according to claim 18 wherein said housing comprises a pedestal member onto which said support structure is mounted, said pedestal member including a central bolt extending longitudingly and centrally thereof from a bottom of said support structure and accessible only from within said opening.

20. A fare box comprising a housing, means defining a slot in the housing for receiving fares therethrough for collecting in the housing, an inspection zone in the housing having a transparent zone wall through which an operator can view a fare deposited in the housing, dump means for temporarily retaining the fare in the inspection zone operable to release the fare therefrom, a vault arranged to receive and retain said fare from said dump means and comprising a container separate from the housing and including means co-operable with the housing such that the container can be inserted into and removed from the housing, said housing comprising an outer casing surrouding and enclosing the parts of the box and acting as a security shroud therefore, and an inner support structure on which the parts of the box are mounted, said transparent zone wall comprising a first transparent screen in said outer casing and a second transparent screen in said support structure aligned with said first transparent screen when said outer casing is in place as a shroud thereon, said first transparent screen being formed from a synthetic plastic material resistant to impact damage and said second transparent screen being formed from glass.

* * * * *